United States Patent [19]

Hale

[11] Patent Number: 4,501,786

[45] Date of Patent: Feb. 26, 1985

[54] COATED PRODUCT WITH OXIDE WEAR LAYER

[75] Inventor: Thomas E. Hale, Warren, Mich.

[73] Assignee: General Electric Company, Detroit, Mich.

[21] Appl. No.: 573,867

[22] Filed: Jan. 25, 1984

Related U.S. Application Data

[63] Continuation of Ser. No. 331,367, Dec. 16, 1981, abandoned.

[51] Int. Cl.[3] ..... B24D 11/00

[52] U.S. Cl. ..... 428/215; 428/699; 428/700; 428/698; 51/293; 51/295

[58] Field of Search ..... 428/215, 698, 699, 700; 51/293, 295

[56] References Cited

U.S. PATENT DOCUMENTS 4,431,431 2/1984 Savin et al. ..... 51/295

4,441,894 4/1984 Savin et al. ..... 51/295

*Primary Examiner*—George F. Lesmes

*Assistant Examiner*—P. R. Schwartz

*Attorney, Agent, or Firm*—Hedman, Gibson, Costigan & Hoare

[57] ABSTRACT

Improved adherence of oxide wear layers on hard metal or cemented carbide substrates is attained by providing a thin surface-oxidized bonding layer comprising a carbide or oxycarbide of at least one of tantalum, niobium or vanadium, optionally adding aluminum to the bonding layer, and finally providing an outer oxide wear layer.

6 Claims, No Drawings

COATED PRODUCT WITH OXIDE WEAR LAYER

This is a continuation of application Ser. No. 331,367, filed Dec. 16, 1981, now abandoned.

This invention relates to coated articles comprising hard metals, refractories, and especially cemented carbide substrates. More particularly, it relates to metallic carbide-, nitride-, or carbonitride, coated hard metal or cemented carbide such products which are adapted to receive an aluminum oxide or other oxide wear layer which is very firmly bonded to the carbide-, nitride-, or carbonitride, coated substrate.

Although the invention will be described with particular reference to metal carbide substrates, other substrates are contemplated, e.g., nickel based alloys, and high melting refractories. Also, although the invention will be described with particular reference to tungsten as the carbide former, other carbide formers such as tantalum and titanium and the like can form the substrate. The carbide or mixed carbides are cemented or bonded together by matrix metals including cobalt, which matrix can also include iron or nickel or both of these metals. A typical cemented carbide contains tungsten carbide in a cobalt matrix. Such carbide-, nitride-, or carbonitride, coated hard metal and/or cemented carbide substrates are used in tools for machining and cutting metals. Their already high wear resistance can be significantly improved by providing oxide wear layers, such as aluminum oxide wear layers, as described in U.S. Pat. Nos. 3,837,896; 3,955,038 and U.S. Pat. No. Re. 29,420.

A coated product consisting of an outer wear layer of an oxide, e.g., aluminum oxide or zirconium oxide, with a minimum thickness of about three microns, an inner layer of carbide or nitride, e.g., of titanium with a minimum layer thickness of about three microns, and a cemented carbide substrate is potentially a highly useful embodiment of the concept. Such a product in the form of an insert for a cutting tool would be expected to operate well at both high cutting speeds (utilizing mainly the oxide wear layer) and low speeds (using the carbide-, nitride- or carbonitride-wear layer).

The drawback until now, to the successful application of this concept, has been the relatively poor bond obtained between the oxide wear layer and the inner, e.g., TiC, layer, causing the oxide layer to spall off in metal-cutting operations when the oxide wear layer thickness is greater than about 1 micron.

Cutting tool materials are commercially available embodying this concept, e.g., using a 1-micron-thick $Al_2O_3$ layer over a 5-microns thick TiC layer. It is probable that the $Al_2O_3$ layer thickness is restricted to 1 micron due to the problem of poor adherence, since the wear resistance would be significantly better if the $Al_2O_3$ layer were thicker (and well bonded).

A method for greatly improving the adherence of an oxide wear coating to the metallic carbide-, nitride- or carbonitride-inner coating has now been discovered and is the subject of the present invention. The method in its broadest aspects consists of interposing a thin (0.1 to 5.0 microns) bonding layer of tantalum, niobium, or vanadium carbide, or oxycarbide between the surface layer ($Al_2O_3$) and the inner layer (TiC, etc.) and then surface-oxidizing and, optionally, metalizing the bonding layer to render it receptive to the oxide wear layer.

In U.S. Pat. No. 4,018,631, it is disclosed that a selective pretreatment of cemented carbides before application of the oxide wear layer unexpectedly enhances and improves the adherence of the subsequently applied oxide wear layer. Specifically, in U.S. Pat. No. 4,018,631 a cemented carbide substrate containing tungsten and cobalt is provided with a coating selected from carbide, nitride, carbonitride and mixtures thereof, then heated to diffuse tungsten and cobalt from the substrate into the coating, the coating is oxidized, and finally the oxidized coating is covered with the oxide wear layer. While such a procedure results in a tightly adherent surface layer of aluminum oxide or other oxide wear layer, and is therefore extremely useful, the procedure is somewhat complicated and expensive to practice because it requires a relatively high temperature for the diffusion step.

In applicant's copending application, Ser. No. 331,368, filed concurrently herewith, a coating procedure is described which provides aluminum oxide and other oxides (e.g., hafnium oxide, zirconium oxide and the like) directly bonded to the substrates with adherence equal to that obtained in the said U.S. Pat. No. 4,018,631 patent, but which can be performed at relatively low temperatures (900°-1150° C.).

Such a procedure in its broadest aspects comprises providing a thin surface-oxidized bonding layer comprising a carbide or oxycarbide of at least one of tantalum, niobium and vanadium, optionally adding aluminum to the bonding layer, and finally providing an outer oxide wear layer.

Such a process is used herein on a substrate which has already been coated with e.g., TiC, TiN, etc.

The product of both the copending application and that disclosed herein differs from that of related prior art using interlayers in basic ways: U.K. Pat. No. 1,284,030 describes the use of an intermediate layer only to provide transition between the substrate and the coating; U.S. Pat. No. 3,640,689 describes an interlayer only to provide a barrier to deleterious reactions; U.S. Pat. No. 3,837,876; 3,955,038 and Re. 29,420, use a carbide (or nitride) intermediate as a barrier but do not provide adherent thick oxide wear layers; Japanese Patent Publications Nos. 23608/1979; 7513/1978; and 26811/1979 describe, respectively, aluminum oxide over a precisely defined titanium carbide double coating using aluminum titanate intermediate layer; a specially defined titanium oxycarbide intermediate layer or two inner layers, one a solid solution, of Ti, Zr, or Hf oxide plus $Al_2O_3$, and the other a carbide, nitride or carbonitride of Ti, Zr or Hf; Japanese Patent Nos. 131909/1978, 158779/1977 and 110209/1977 disclose, respectively, inner layers of complex compounds of oxygen, carbon, or nitrogen containing metals of Groups IVA, VA or VIA; TiC, TiN, TiCO, TiNO, or TiCNO, or carbides, nitrides, carbonitrides, or oxides of IVA, VA, VIA metals; and Japanese Patent Nos. 89805/1978, 23810/1978, 158775/1979, 35182/1979 and 158780 disclose, respectively, complex intermediate layers of titanium oxycarbonitride, titanium oxycarbide, $Ti(C,O)_x$ inner, (Ti,Al)(N,O)y outer; carbide or carbonitride inner, carbide, oxycarbide, nitride, nitro-oxide carbonitride and/or oxycarbonitride; and TiC, TiN, TiCN, TiCO, TiNO, or TiCNO. The present bonding layer is thin, not useful as a barrier, and possesses a composition novel in its chemical constituents. All of the foregoing patents and publications are incorporated herein by reference.

DESCRIPTION OF THE INVENTION

According to the present invention, there is provided an article of manufacture comprising:

(i) a hard metal or cemented carbide substrate;

(ii) an inner layer lying next to said substrate, said inner layer comprising a carbide or nitride or a carbonitride of titanium, zirconium, hafnium, vanadium, columbium, tantalum, chromium, molybdenum tungsten, silicon or boron;

(iii) a surface-oxidized bonding layer adjacent the surface of said inner layer (ii), said bonding layer comprising at least one of the carbides or oxycarbides of tantalum, niobium and vanadium; and (iv) an oxide wear layer overlying said bonding layer (iii).

In preferred features, the substrate is a cemented carbide; the inner layer is 1 to 10 microns thick, the bonding layer is 0.1 to 0.5 microns thick; aluminum is added to the bonding layer and/or iron, cobalt or nickel are included by a process to be described later, the oxide wear layer is aluminum oxide; and the wear layer is 0.5 to 20 microns thick.

In the process of the present invention a hard metal or cemented carbide substrate, already provided with a surface layer of a carbide, nitride, or carbonitride as defined above, is pretreated for the reception of a wear resistant oxide coating by (a) treating the substrate and surface layer in a first atmosphere selected from carbide and oxycarbide forming atmospheres to form a bonding layer of metal selected from at least one of tantalum, niobium or vanadium on said substrate; and (b) heating the coated substrate of (a) in a second, oxidizing atmosphere until at least about 50% of the surface is oxidized.

In preferred features of the process aspect the bonding layer will be treated with aluminum and/or iron, cobalt or nickel, and an oxide wear layer, preferably an aluminum oxide wear layer, will be deposited on the bonding layer, whether or not other metals have also been included.

Those skilled in this art will know the general techniques used to prepared the products and carry out the process of the present invention.

One convenient way of proceeding is to provide a coating furnace held at a temperature of from about 800° C. to 1300° C., and to expose a carbide-, nitride-, or carbonitride-coated substrate in the furnace to the following sequential steps:

1. 5 to 60 minutes' exposure, preferably at 1050° C., to a gaseous mixture of $H_2$ and 0.5 to 20 volume percent $TaCl_5$ or $NbCl_5$ to provide the bonding layer. $TiCl_4$ and $CH_4$ may be optionally added during either part or all of this period.

2. 1 to 60 minutes' exposure, preferably at 1100° C., to a gaseous mixture consisting of $H_2$ and about 1 to 50 volume percent $CO_2$ to oxidize and produce the carbide-, nitride-, or carbonitride-coated substrate.

3. 5 to 60 minutes exposure, preferably at 1050° C., to a gaseous mixture of $H_2$ and about 0.5 to 20 volume percent $AlCl_3$. This aluminization step is optional but is preferred for best results.

4. 15 minutes' to 4 hours exposure, preferably 1050° C., to a gaseous mixture of $H_2$, 1 to 40 (or 60 to 95) volume percent $CO_2$, and 2.5 to 20 volume percent $AlCl_3$ to produce the aluminum oxide wear coating.

Other suitable treating atmospheres of varying proportions of constituents will occur to those skilled in the art. Likewise, other well known deposition techniques can be used such as physical vapor deposition, sputtering and pack diffusion.

Those features of the invention which are believed to be novel are set forth with particularity in the claims appended hereto. The invention will, however, be better understood from a consideration of the preferred embodiments.

DESCRIPTION OF THE PREFERRED EMBODIMENTS

The following examples are illustrative, and the claims are not to be construed as being limited thereto.

EXAMPLE 1

A commercial cemented carbide cutting tool insert comprising 85.5% WC, 6% TaC 2.5% TiC and 6% Co and coated with TiC of five microns thickness is subjected to the following sequence of steps in a furnace at temperature of 1050° C. and 1 atmosphere pressure:

1. 2 minutes in an atmosphere of $H_2$ and approximately 2% $TiCl_4$.

2. $NbCl_5$ vaporizer on 8 min. to 225° F., 3 min. hold—15 min. power off-cool.

3. 1 minute in an atmosphere of hydrogen—3.5% $CO_2$ to surface oxidize.

4. 10 minutes in an atmosphere of hydrogen—5% $AlCl_3$.

5. 60 minutes in an atmosphere of hydrogen 5% $AlCl_3$—7% $CO_2$.

This treatment resulted in a 3–4 microns $Al_2O_3$ coating which was firmly bonded to the TiC coated cemented carbide substrate, through a bonding layer approximately 0.2 microns thick.

The coating adhesion of this insert was sufficient to meet the requirements of commercial $Al_2O_3$-coated substrates, without a TiC layer. Direct deposit of $Al_2O_3$ on inserts coated with TiC fail to meet these requirements.

EXAMPLE 2

Iron was incorporated into the surface of a TiC coated cemented carbide cutting tool insert by rubbing its cutting surfaces with a piece of soft iron. The general procedure of Example 1 was then used to deposit a very thin coating of niobium carbide by the exposure of the treated surface to a mixture of $H_2$ and $CbCl_5$ gases for about 10 minutes at 1050° C. The resultant CbC coating was allowed to diffuse with the Fe (and TiC) for about 20 minutes and then this surface was lightly oxidized by exposure to a mixture of $H_2$-5% $CO_2$ at 1050° C. for about 5 minutes. When subsequently $Al_2O_3$-coated, a very strong bond was obtained between the $Al_2O_3$ coating and the TiC-coated surface, noticeably better than the adhesion obtained using the same process without the Fe treatment.

The use of tantalum or columbium chloride in the steps of the above examples is critically specific for the achievement of the desired high level of coating adherence in a single furnace operation. While titanium chloride may be used in these steps in addition to tantalum or niobium chloride, good adherence is not obtained if only titanium chloride is used. Since vanadium belongs to the same group as tantalum and niobium (Group VB), its effectiveness is probable.

Many variations will suggest themselves to those skilled in this art in light of the above-detailed description. All obvious such variations are within the full intended scope of the invention as defined by the appended claims.

I claim:

1. An article of manufacture comprising (i) a hard metal or cemented carbide substrate;

(ii) an inner layer lying next to said substrate, said inner layer comprising a carbide, a nitride or a carbonitride of titanium, zirconium, hafnium, vanadium, columbium, tantalum, chromium, molybdenum or tungsten (iii) a surface-oxidized bonding layer adjacent the surface of said inner layer (ii), said bonding layer comprising at least one of the carbides or oxycarbides of tantalum, niobium and vanadium; and (iv) an oxide wear layer overlying said bonding layer (iii).

2. An article as defined in claim 1 wherein the substrate is a cemented carbide, inner layer (ii), is 1 to 10 microns thick and bonding layer (iii) is 0.1 to 0.5 microns thick.

3. An article as defined in claim 1 wherein bonding layer (iii) (a) contains aluminum, (b) includes a metal selected from iron, cobalt, nickel or a mixture thereof, or is (c) a combination of (a) and (b).

4. An article as defined in claim 1 wherein inner layer (ii) comprises titanium carbide.

5. An article as defined in claim 1 wherein oxide wear layer (iv) comprises aluminum oxide.

6. An article as defined in claim 1 wherein oxide wear layer (iv) is 0.5 to 20 microns thick.

* * * * *